United States Patent [19]

Ryan

[11] Patent Number: 4,960,150

[45] Date of Patent: Oct. 2, 1990

[54] MOVABLE SAFETY COVER FOR VEHICLE SERVICE PIT

[76] Inventor: Alex Ryan, 3104 Oakdale Ct., Hurst, Tex. 76054

[21] Appl. No.: 373,589

[22] Filed: Jun. 30, 1989

[51] Int. Cl.[5] ..... B60S 3/04

[52] U.S. Cl. ..... 137/234.6; 49/33; 49/127; 49/130; 220/345

[58] Field of Search ..... 49/33, 125, 127, 128, 49/130; 220/379, 345; 52/169.7; 137/234.6

[56] References Cited

U.S. PATENT DOCUMENTS

| | | | |
|---|---|---|---|
| 2,223,023 | 11/1940 | Weilemann | 220/345 |
| 2,848,722 | 8/1958 | Choports | 49/33 X |
| 3,226,778 | 1/1966 | Kollsman et al. | 49/130 |
| 3,654,732 | 4/1972 | Schacht | 49/127 |
| 3,866,624 | 2/1975 | Peterson | 137/234.6 |
| 4,188,985 | 2/1980 | Osterman | 52/169.5 |
| 4,616,451 | 10/1986 | Glick | 49/125 |
| 4,762,242 | 8/1988 | Harris et al. | 220/18 |

*Primary Examiner*—Gary L. Smith
*Assistant Examiner*—Jerry Redman
*Attorney, Agent, or Firm*—James E. Bradley

[57] ABSTRACT

A movable safety cover for covering an elongated opening in a floor. Has a plurality of deck carriers positioned adjacently and supported on each elongated side of the opening by a respective carrier track. Has track roller members mounted at each end of the side members of a carrier in a position slightly out of contact with the track member when the side members are in frictional contact and engaging the track in rolling relation when one end of the carrier is lifted up slightly from the frictional contact of the tracks. Has a plurality of low profile rolling ball transfer members mounted on top of the side members to permit the carrier to roll across the top of an adjacent carrier. Each of the track roller members is mounted to extend slightly above each side member to permit each side of an adjacent carrier to roll as the adjacent carrier member is lifted at one end to engage its roller members into rolling engagement with the track and is pushed horizontally while lifted to place the bottom of the adjacent side members on top of adjacent roller members. The carrier may be pulled up and tilted to horizontal to roll on the rolling ball transfer members.

20 Claims, 2 Drawing Sheets

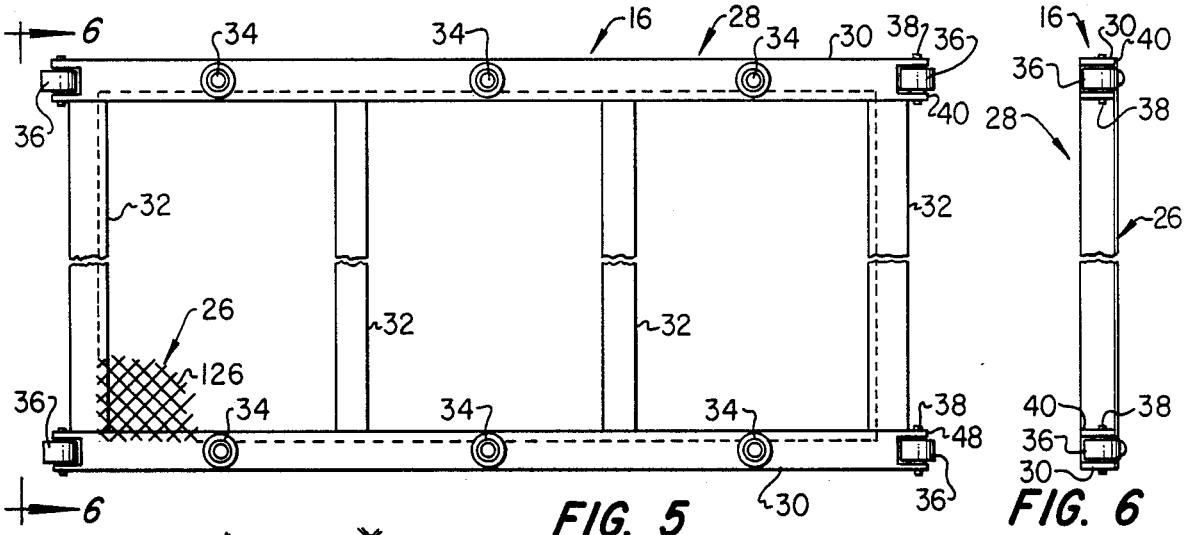
FIG. 5
FIG. 6
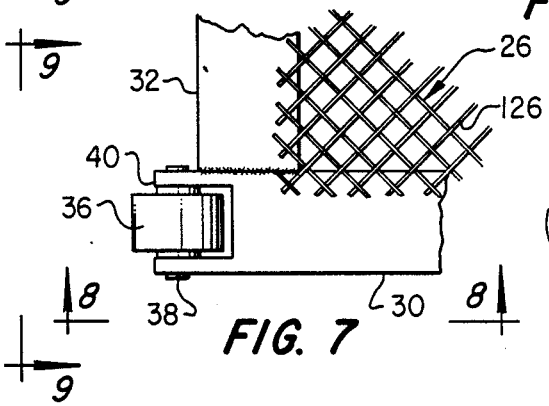
FIG. 7
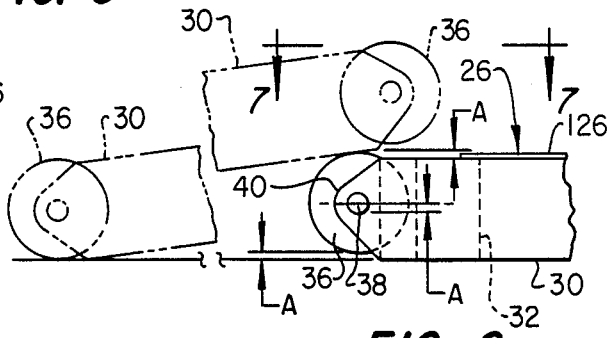
FIG. 8
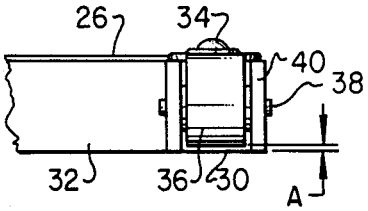
FIG. 9
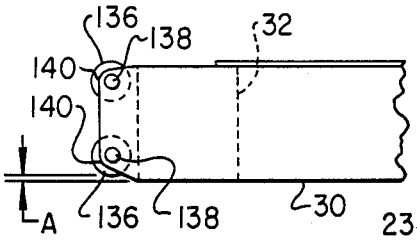
FIG. 11
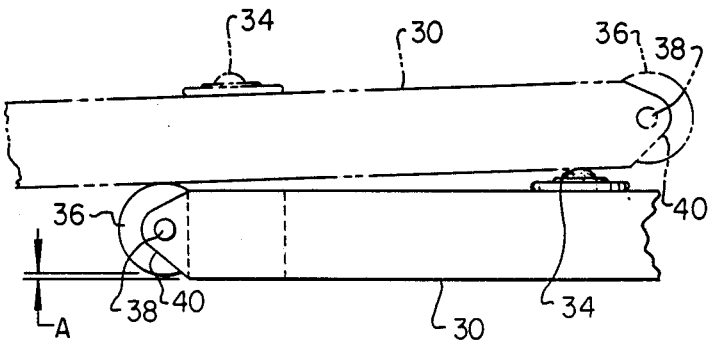
FIG. 10
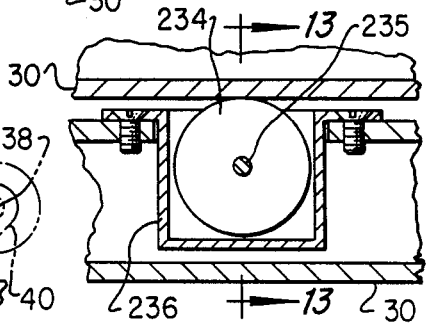
FIG. 12
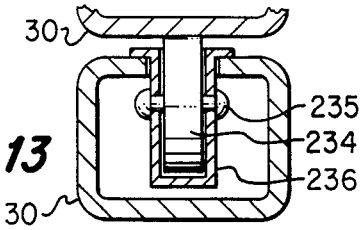
FIG. 13

MOVABLE SAFETY COVER FOR VEHICLE SERVICE PIT

Field of the Invention

This invention generally relates to movable covers for hatches, service pits, vault covers, and the like, and more particularly pertains to a movable and adjustable safety cover for vehicle service pits.

BACKGROUND OF THE INVENTION

Automobile lubrication stores and other vehicle service stores usually have a maintenance facility that consists of one or more service pits, each being approximately a three feet by seventeen feet opening in the floor. The automobile is driven over this service pit, and the worker gains access to the undercarriage of the vehicle while working from a room or pit beneath the automobile by reaching up through the service pit opening. This service pit opening is inherently dangerous to both the employees and to the customers of the store because of the probability of serious injury or death if a person were to slip or fall from the upper level into the eight (8) foot deep pit.

While the service pits usually have a roaming around the pit to prevent flow of water into the pit and to guide vehicles over the pit, there are usually no protective rails or other protective devices around the pit.

Employees are seen to routinely jump over the pit during the course of their movement around the shop. Also, customers who wander into the shop usually walk over to the edge of the pit to look in. Small children are particularly prone to investigate the pit.

Such an open pit violates basic rules of employee and customer safety and could be a great source of potential negligence claims to the store and the insurer of the store as well as being a source of violations and fines from state and federal government agencies such as OSHA.

The presently known prior art are U.S. Pat. Nos. 742,075; 3,866,624; 3,938,621; 4,188,985; and 4,762,242.

OBJECTS OF THE INVENTION

One object of the present invention is to provide a safety cover consisting of individual carriages and carriage tracks placed in and over the auto maintenance pit that protects workers and customers from falling into the pits while at the same time allowing the workers full access to the undercarriage of the auto for service.

Another object of the present invention is to provide a safety deck carriage made of a frame and deck grate with roller wheels and with rolling transfers on top of each carriage, which is movable on a steel track which is supported from the sides of the pit to support the carriages, wherein the individual carriages are light enough to be easily lifted and rolled back by one man to gain access to the undercarriage of an auto.

Another object of the present invention is to provide a safety cover which is above the movable oil service rack and no higher than the two inch steel roaming or rim of the pit, wherein the safety covers will not interfere with the movement of the oil service rack or of access to the auto.

A further object of the invention is to provide a safety cover which is used to cover the pit at all times and the only opening to the pit will be when a worker moves one of the deck carriers to gain access to the auto wherein the panel should and can be rolled back into place before the auto is driven from the pit.

SUMMARY OF THE INVENTION

The foregoing and other objects and advantages of the invention are provided by a movable safety cover apparatus for covering an elongated opening in a floor which includes a plurality of deck carriers positioned adjacently to one another and supported on each elongated side of the opening by a respective carrier track wherein a side member on each side of the carrier member is in surface-to-surface frictional contact with a respective carrier track. Roller members are mounted at each end of the side members in a position slightly out of contact with a track member when the side members are in the frictional contact with the track and in a rolling relation when one end of the deck carrier is lifted up slightly from the frictional contact. A plurality of low profile rolling ball transfer members are mounted on top of each of the side members to permit each deck carrier to roll across the top of an adjacent deck carrier. Each roller member is mounted to extend slightly above each side member to permit each side of an adjacent track carrier to roll when the adjacent deck carrier is lifted at one end to engage its roller members into rolling engagement with the track and is pushed while lifted to place the bottom of the adjacent side members on top of adjacent roller members. The adjacent deck carrier may be rolled up the roller members and then tilted to horizontal to roll on said rolling ball transfer members.

The carrier track is mounted along two sides of the opening to support the side members of the deck carriers. The carrier track is made up of a hook shaped retaining member mounted along a longitudinal roaming along the elongated sides of the opening. The horizontal track member may be made with a horizontal mounting flange supported by the horizontal edge of the elongated pit opening. The rolling transfer members may be rolling ball transfer members or small fixed wheel casters having a very low profile. Each of the roller members is a cylindrical roller mounted in a clevis formed at each end of each of the side members.

BRIEF DESCRIPTION OF THE DRAWING

FIG. 3-A is an alternate to the structure of FIG. 3 and showing a carrier support track mounted with expansion bolts rather than, to a pit coaming;

FIG. 4-A is the same view as FIG. 4 with the deck carriers positioned together in adjacent position to completely close the pit as when the pit is not in use;

FIG. 4-B is the view of FIG. 4 with the deck carriers having no end support rollers;

FIG. 5 is a plan view of one of the deck carriers showing the ball transfer rollers and the end support rollers as mounted on the structure of the carrier;

FIG. 6 is an elevational view taken at line 6—6 of FIG. 5 and showing the end rollers and the deck covering;

FIG. 7 is a plan view of one corner of the deck carrier as taken along the line 7—7 of FIG. 8 and showing the deck fastening and the end roller in more detail;

FIG. 8 is a side elevation as taken line 8—8 of FIG. 7 and showing a side member and an end roller in more detail;

FIG. 9 is an elevation as shown from line 9—9 of FIG. 7 and showing a view of the end roller with a ball transfer roller in the background;

FIG. 10 is a side elevation such as shown in FIGS. 4 and 8 with an adjacent deck carrier having been lifted and placed with an end roller in contact with the bottom of the side member and a ball transfer roller beginning to engage another portion of the bottom of the side member;

FIG. 11 is a side elevational view similar to FIGS. 8 and 10 and showing an alternate arrangement of an end roller wherein two smaller rollers are utilized to operate independently;

FIG. 12 is a side elevational view showing a roller transfer embodiment alternate to the ball transfer members shown in FIGS. 4 and 5;

FIG. 13 is a lateral cross-section of the side member shown in FIG. 12 as taken along the line 13—13 of FIG. 12.

DESCRIPTION OF THE PREFERRED EMBODIMENTS

Figure 1:
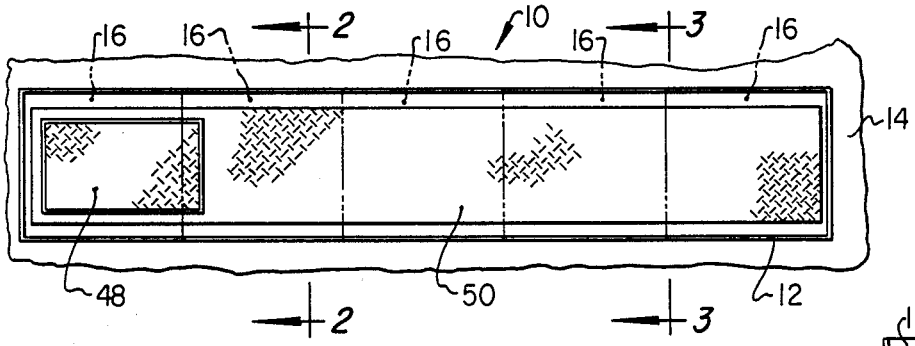
FIG. 1 is a partly schematic plan view of an open vehicle service pit and showing the deck carriers in dashed lines with a walkway deck and an optionally movable grease rack assembly.

Referring first to FIGS. 1-3A, an installation of pit cover apparatus 10 is shown which includes a pit coaming 12, concrete sides and bottom 14, and a plurality of movable deck carriers 16. In FIG. 1 there is shown a walkway grate 50 along the bottom of the pit 10 and a grease rack 48 which optionally may be movable along the bottom of the pit.

Figure 2:
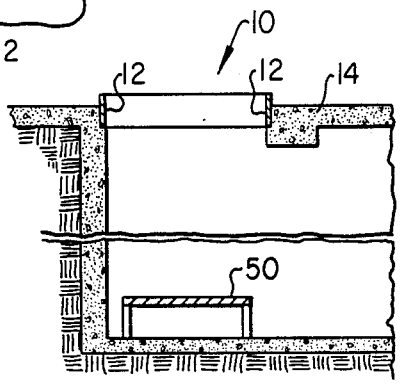
FIG. 2 is a schematic cross-sectional view of the vehicle service pit as seen from the line 2—2 of FIG. 1.

FIG. 2 is taken along the line 2—2 of FIG. 1 and shows a cross-sectional view of the pit 10 with the coaming 12, the walkway 50, and the cement structure 14. It is to be noted that a worker performs all work while standing on the walkway 50 and reaching up through an opening between the deck carriers 16. The worker moves the carriers 16 as needed.

Figure 3:
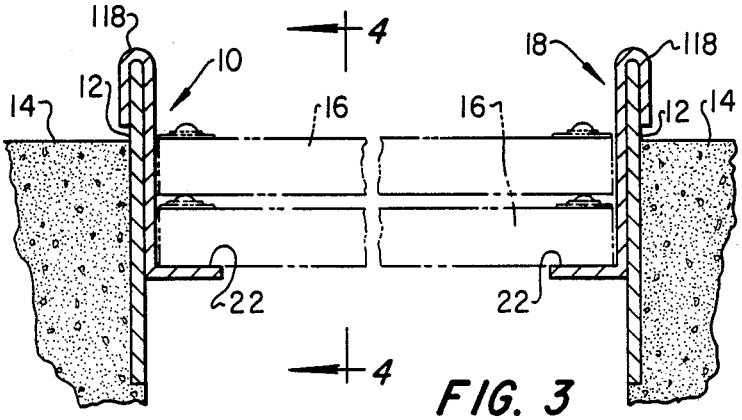
FIG. 3 is a schematic cross-sectional view of the upper part of the vehicle service pit as seen from the line 3—3 of FIG. 1 and showing the pit coaming with the carrier support tracks and with a plurality of movable deck carriers illustrated in dashed lines.
Figure 3A:
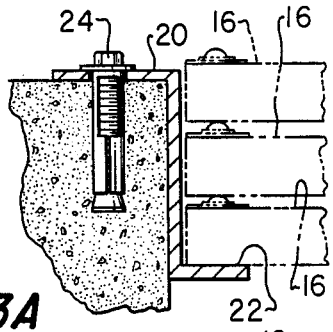

Shown in FIG. 3 is a larger view of the pit coaming 12. Hook type carrier support tracks 18, which form a carrier track 22 and a hook member 118, are located on each side of the longitudinal sides of the coaming 12. A plurality of the deck carriers 16 are disposed in these racks 22 throughout the length of the pit 10. The track supports 18, as shown, are usually made of heavy gauge metal which has been forced by a break machine to the shape and proportion shown. Each carrier assembly unit may have one deck carrier 16 and a pair of carrier track supports 18 of the same length.

An alternate embodiment of a track support 20 is shown in FIG. 3-A. This type of track is for use where the pit 14 is not completed with a coaming 12 as shown in FIG. 2. In this instance the track support 20 also supports a track 22 and is bent into a right angle at the top to be laid flush with the cement floor and positioned into place by a plurality of expansion bolts 24.

Figure 4B:
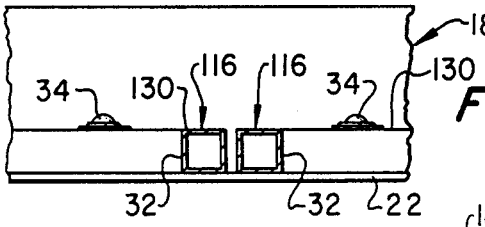
FIG. 4 is a lateral cross-sectional elevational view of the deck carriers and support track as seen from line 4—4 of FIG. 3.
Figure 4:
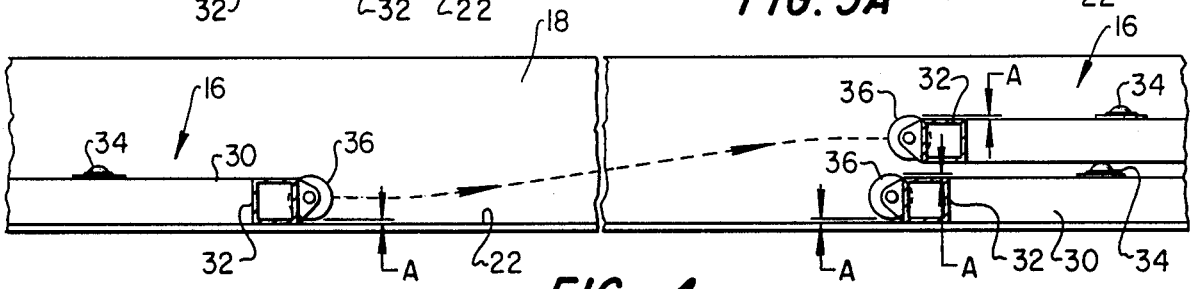
Figure 4A:
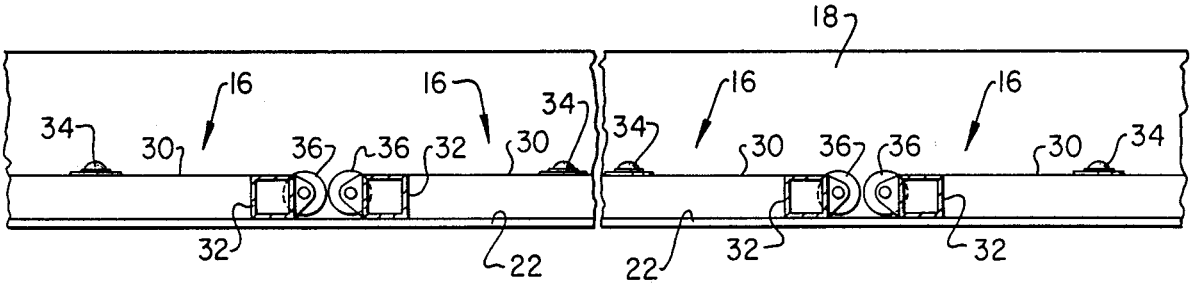

FIGS. 4-6 illustrate the deck carriers 16 in more detail. As shown, each deck carrier 16 includes a carrier frame 28 each having two side members 30, a deck 26, and cross members 32. As here illustrated, the side members 30 are made of structural box members. However, the side member 30 could be angle members or "U" members with some modification to function as herein described. The deck member 26 is preferably ventilated as with a heavy expanded mesh grate 126 welded to frame 28 or a prefabricated bar grate (not shown) fastened to frame 28. The deck 126 is preferably ventilated to permit air circulation and to permit visual observation from below or above the deck. Also, deck 126 is ventilated so that automotive liquids as may leak out of an automobile during the service work will not be collected on the deck.

The side bar members 30, which are supported as shown by supporting cross members 32, are each equipped with a plurality of low profile ball transfer members 34. These ball transfer members as shown are generally mounted in circular holes cut into the top of the side members 30 and fastened to the members 30 by means of screws or bolts (not shown).

Each of the ball transfer members 34 will extend upwardly from the surface of the cross member 30 by about $\frac{3}{8}''$ to $\frac{3}{4}''$, for example. As the deck 26 is assembled, the grate 126 will have a thickness of 3/16" to maybe 5/16", for example, and will be fitted around each of the transfer members 34 as necessary.

Such low profile ball transfer members as shown at 34 is an item which may be readily purchased from stock. A supplier of such ball transfer members is, for example, ACME CASTER COMPANY, 86 Washington Street, Poughkeepsie, N.Y. 12601. Another supplier may be, for example, BASSICK DIVISION, BORG-WARNER CORPORATION, 965 Atlantic Street, Bridgeport, Conn. 06602. The roller balls in these transfer members 34 roll on much smaller balls (not shown) housed within the housing of each member 34.

As seen in FIGS. 4, 4-A, 5, and 6, a plurality of end rollers 36 of the fixed caster type are respectively mounted at each end of each side member 30. Further details of these rollers 36 are illustrated in FIGS. 7, 8, and 9. As shown, each roller 36 is rotatably mounted on a roller axle 38 which is fastened between arms of a clevis 40.

The outside diameter of each roller 36 may be the same as the cross-sectional height of each side member 30, a distance of $1\frac{1}{2}''$ for example.

The dimension A of clearance of the roller 36 from the track 32, as shown in FIGS. 4, 8, and 9 for example, may be in the order of 1/16".

As best shown in FIGS. 4, 8 and 9, the axle 38 which supports the roller 36 is disposed slightly off the centerline of the side member 30 by a short distance such that the roller 36 is not in contact with the track 22 as shown in FIG. 4 while the side member 30 is disposed in surface-to-surface contact with the track 22. However, when one end of the deck carrier 16 is raised slightly from the surface of the track 22, then the roller 26 is brought down into rolling contact with the track 22. This rolling contact may begin as the deck carrier 16 is raised from 5° to 10° with respect to the track 22.

The worker disposed in the pit can tilt up one end of a deck carrier 16 such that it will readily roll onto the roller 36 of an adjacent deck carrier 16, and, after the center of the tilted carrier 16 passes across the adjacent roller 36, the tilted carrier 16 will be pivoted over into a horizontal position and supported by the ball transfer members 34. As best seen in FIG. 10, the dimensions of the roller 36 and the first ball transfer member 34 may be such that the moving tilted carrier 16 engages the transfer member 34 on or about the time the roller 36 has reached the center of the adjacent carrier 16. This structure and arrangement makes it very easy for a worker in the pit to move the respective deck carriers 16 up onto adjacent deck carriers 16 with very little effort.

As seen in FIG. 1–3A, virtually any combination of the carrier members 16 may be moved and stacked as necessary to properly service an automobile which is positioned above the pit 10.

FIG. 4-B shows an alternate embodiment of deck carriers 16 wherein each carrier is completed without the end rollers 36. In this embodiment, the worker would push up one end of the deck carrier 16 higher than the top of the adjacent carrier and physically skid the other end along the track 22 until the roller transfer members 34 were reached. The other end of the carrier 16 would then be raised to roll the carrier on to the top of the adjacent carrier. With very light deck carriers, this embodiment is, of course, operable. However, when the carrier 16 is provided of heavier and stronger material, this embodiment becomes increasingly cumbersome to move if the worker is moving to service different parts of a vehicle.

It is also contemplated that at any time an automobile is driven off of the pit 10, all the covers 16 will be resting on their respective tracks 22 such that no person may fall into the pit and no automobile is likely to push through the grates.

The FIGS. 7, 8, and 9 are further details of the structure shown in FIGS. 4, 4-A, 5, and 6. FIG. 10 illustrates the rolling action when one deck carrier 16 is tilted and rolled above another deck carrier 16.

FIG. 11 illustrates an alternate embodiment of the structure in FIGS. 7, 8 and 9 wherein two small rollers 136 are disposed in substitute for the one larger roller 36. As with the roller 36 in FIG. 10, the axles 138 of the two smaller rollers 136 will be positioned such that the lower roller is slightly out of contact with track 22 and the upper roller is slightly above the side members 30 so that the action of the two rollers of FIG. 11 is substantially the same as the action of the single roller of FIG. 10.

In FIGS. 12 and 13, an alternate embodiment to the low profile ball transfer members 34 is illustrated. In this embodiment, a larger roller 234 is mounted within a roller housing 236 and rotatably supported by a roller axle 235. This kind of roller assembly is readily understood, and roller assemblies of this type are now in use in patio doors, the "pocket" roller doors in houses, and the like.

It is to be noted that the structure of the deck carriers 16 as described above may be fabricated entirely of steel materials which are readily available. The deck carriers 16 may also be manufactured of all aluminum materials except perhaps for the axles and roller bearings as herein described. The advantage of the aluminum structure over the steel structure is, of course, that the aluminum structure would be of lighter weight and would require less effort for a worker to move the deck carriers about as described. On the other hand, the steel structures would bear more weight without damage from heavier objects such as when an automobile wheel inadvertently rolled onto the top of the deck support carrier 16.

It is again noted that the combination of the deck carriers 16 as shown herein would be operable and useable in the situation when the carrier frame 28 was completed without any of the rollers 36 shown in FIG. 4-B and as herein described. This embodiment would present only a frictional metal-to-metal contact of the side member 30 and the track 22 when the carrier 16 is tilted and moved upwardly over an adjacent carrier 30. In this instance, the adjacent ball transfer members 34 may be placed closer to the end of each member 30 whereby the adjacent carrier 16 could be lifted to roll on the transfer member 34 with less horizontal skidding movement of the moving carrier 16.

It will be apparent to those skilled in the art that there are modifications and revisions which may be made to the embodiments as herein illustrated which will also be within the scope and purview of the appended claims.

What is claimed:

1. A movable safety cover apparatus for covering an elongated opening in a floor, comprising in combination:

(a) a plurality of deck carriers positioned adjacently and supported on each elongated side of said opening by a respective carrier track wherein a side member on each side of said carrier member is in surface-to-surface frictional contact with a respective carrier track;

(b) a roller member mounted at each end of each of said side members in a position slightly out of contact with a respective carrier track when said side members are in said frictional contact and in position for engaging said track in rolling relation when one end of said deck carrier is lifted up slightly from said frictional contact;

(c) a plurality of low profile rolling transfer members mounted on top of each of said side members to permit each deck carrier to roll across the top of an adjacent deck carrier;

(d) each said roller member being mounted to extend slightly above the bottom of each said side member to permit each side of an adjacent deck carrier to roll when said adjacent carrier is lifted up at one end to engage its roller members into rolling engagement with said track and is pushed while lifted to place the bottoms of said adjacent side members on top of adjacent roller members; and (e) wherein said adjacent deck carrier may be rolled up said roller members then tilted to horizontal to roll on said rolling transfer members.

2. The apparatus of claim 1 wherein said carrier track is mounted along two sides of said opening to support said side members of said deck carriers.

3. The apparatus of claim 2 wherein said carrier track comprises a hook shaped retaining member mounted along a longitudinal coaming along the sides of said opening.

4. The apparatus of claim 2 wherein said carrier track comprises a horizontal mounting flange supported by the horizontal edge of said elongated opening.

5. The apparatus of claim 1 wherein said rolling transfer members are rolling ball transfer members.

6. The apparatus of claim 1 wherein each of said rolling members is a cylindrical roller mounted in a clevis formed at each end of said side member.

7. The apparatus of claim 1 wherein said rolling transfer member is a cylindrical roller inset into said side member.

8. A movable safety cover apparatus for covering an elongated opening in a floor comprising in combination:

(a) a plurality of deck carriers positioned adjacently and supported on each elongated side of said opening by a respective carrier track wherein a side member on each side of said deck carrier is in surface-to-surface frictional contact with a respective carrier track;

(b) a plurality of low profile rolling transfer members mounted on top of each of said side members to permit each said deck carrier to roll across the top of an adjacent deck carrier;

(c) each said rolling transfer member being mounted to extend slightly above each said side member to permit each side of an adjacent carrier to roll when said adjacent carrier is lifted at one end to engage said rolling transfer members then pushed while being lifted to place the bottom of said adjacent side members on top of adjacent rolling transfer members;

(d) said adjacent deck carrier being skidded and tilted to horizontal to roll on said rolling transfer members.

9. The apparatus of claim 8 wherein said carrier track is mounted along the elongated sides of said opening to support said side members of said deck carriers.

10. The apparatus of claim 9 wherein said carrier track comprises a hook shaped retaining member mounted along a coaming positioned along the elongated sides of said opening.

11. The apparatus of claim 8 wherein said horizontal track member comprises a horizontal mounting flange supported by a horizontal edge of said elongated opening.

12. The apparatus of claim 8 wherein said rolling transfer members are rolling ball transfer members.

13. The apparatus of claim 8 wherein said rolling transfer members are cylindrical rollers inset into said side members.

14. A movable safety cover apparatus for covering an elongated opening comprising:

(a) a plurality of deck carriers positioned adjacently and supported on each elongated side of said opening by a respective carrier track wherein a side member on each side of said carrier member is in surface-to-surface frictional contact with a respective carrier track;

(b) cylindrical roller members mounted at each end of said side members in a position slightly out of contact with said tracks when said side members are in said frictional contact and engaging said tracks in rolling relation when one end of said deck carrier is lifted up slightly from said frictional contact;

(c) a plurality of rolling transfer members mounted on top of each of said side members to permit each said deck carrier to roll across the top of an adjacent deck carrier;

(d) each said roller transfer member being mounted to extend slightly above each side member to permit each side member of an adjacent deck carrier to roll as said adjacent deck carrier is lifted at one end to engage its cylindrical roller members into rolling engagement with said track and is pushed while lifted to place the bottom o-f said adjacent side member on top of an adjacent roller transfer member;

(e) wherein said adjacent deck carrier may be rolled up said roller members and tilted to a horizontal position to roll on said rolling transfer members.

15. The apparatus of claim 14 wherein said carrier track is mounted along two sides of said opening to support said side members of said deck carriers.

16. The apparatus of claim 15 wherein said carrier track comprises a hook shaped retaining member mounted along a longitudinal coaming along the sides of said opening.

17. The apparatus of claim 14 wherein said horizontal track member comprises a horizontal mounting flange supported by a horizontal edge of said elongated opening.

18. The apparatus of claim 16 wherein said rolling transfer members are rolling ball transfer members.

19. The apparatus of claim 18 wherein each of said rolling members is a cylindrical roller mounted in a clevis formed at each end of said side member.

20. The apparatus of claim 16 wherein said rolling transfer members are cylindrical rollers inset into said side members.

* * * * *